US010889393B2

(12) United States Patent
Stange et al.

(10) Patent No.: US 10,889,393 B2
(45) Date of Patent: Jan. 12, 2021

(54) MACRO BLISTER PACKAGING

(71) Applicant: BAYER PHARMA AKTIENGESELLSCHAFT, Berlin (DE)

(72) Inventors: Olaf Stange, Berlin (DE); Johannes-Walter Höhl, Burscheid (DE); Reiner Diederich, Wesseling (DE); Klaus Dröder, Wolfenbüttel (DE); Christoph Herrmann, Braunschweig (DE); Franz Dietrich, Braunschweig (DE); Philipp Blumenthal, Braunschweig (DE); Kai Stühm, Braunschweig (DE); Paul Bobka, Halle (DE); Christopher Schmidt, Wolfenbüttel (DE); Sebastian Thiede, Braunschweig (DE)

(73) Assignee: BAYER PHARMA AKTIENGESELLSCHAFT, Berlin (DE)

( * ) Notice: Subject to any disclaimer, the term of this patent is extended or adjusted under 35 U.S.C. 154(b) by 304 days.

(21) Appl. No.: 15/754,858

(22) PCT Filed: Aug. 18, 2016

(86) PCT No.: PCT/EP2016/069560
§ 371 (c)(1),
(2) Date: Feb. 23, 2018

(87) PCT Pub. No.: WO2017/032674
PCT Pub. Date: Mar. 2, 2017

(65) Prior Publication Data

US 2018/0319519 A1 Nov. 8, 2018

(30) Foreign Application Priority Data

Aug. 25, 2015 (EP) ..... 15182316

(51) Int. Cl.
*B65B 9/04* (2006.01)
*B65D 75/32* (2006.01)
(Continued)

(52) U.S. Cl.
CPC ..... *B65B 9/045* (2013.01); *A61J 1/035* (2013.01); *B65D 75/327* (2013.01); *B65D 83/0805* (2013.01); *B65D 2203/06* (2013.01)

(58) Field of Classification Search
CPC .... B65B 9/045; B65D 75/327; B65D 75/367; A61J 1/035
(Continued)

(56) References Cited

U.S. PATENT DOCUMENTS 3,903,773 A * 9/1975 Furukawa ..... A47F 1/10 83/208
4,317,399 A * 3/1982 Romagnoli ..... B65B 61/065 83/237
(Continued)

FOREIGN PATENT DOCUMENTS

CN 203003955 U 6/2013
DE 3803979 A1 8/1989
(Continued)

OTHER PUBLICATIONS

International Search Report dated Oct. 10, 2016 issued in corresponding PCT/EP2016/069560 application (2 pages).
(Continued)

*Primary Examiner* — Stephen F. Gerrity
(74) *Attorney, Agent, or Firm* — Millen White Zelano and Branigan, PC

(57) ABSTRACT

The invention relates to a macroblister comprising a flat body, in which are introduced cavities for receiving individual medicament portions, wherein the cavities are filled with individual medicament portions and are sealed with a
(Continued)

foil. According to the invention, said macroblister contains a number T of medicament portions, characterized in that T is at least 60 and the flat body has a dimension in the range of 200 mm×200 mm to 1200 mm×1200 mm.

33 Claims, 7 Drawing Sheets

(51) Int. Cl.
*A61J 1/03* (2006.01)
*B65D 83/08* (2006.01)

(58) Field of Classification Search
USPC ..... 53/453, 559; 206/534
See application file for complete search history.

(56) References Cited

U.S. PATENT DOCUMENTS 4,384,649 A 5/1983 Brodsky
4,612,755 A 9/1986 Cavanagh
4,750,318 A 6/1988 Matsuzawa
6,055,794 A * 5/2000 Breitler ..... B65B 9/045 53/453
6,516,949 B2 2/2003 Fuller et al.
6,988,619 B2 1/2006 Klatt
7,797,912 B2 * 9/2010 Hammond et al. ..... B65B 47/02 53/453
8,024,911 B2 * 9/2011 Hultberg et al. ..... B65B 9/045 53/411
8,365,504 B2 * 2/2013 Tampieri et al. ..... G06K 19/14 235/380
2003/0136698 A1 7/2003 Klatt
2005/0016134 A1 * 1/2005 Prebelli et al. ..... B65B 61/06 53/559
2005/0259818 A1 * 11/2005 Silverbrook et al. ..... G06Q 10/087 380/55
2008/0271417 A1 * 11/2008 Drost et al. ..... B65B 5/103 53/443
2009/0057421 A1 * 3/2009 Suorsa et al. ..... G06Q 10/08 235/494
2009/0077932 A1 3/2009 Cope et al.
2009/0202635 A1 * 8/2009 Scott ..... A61K 9/0056 424/468
2011/0011880 A1 1/2011 Garcia Sala
2011/0078981 A1 * 4/2011 Bongers-Ambrosius et al. ..... G06K 19/14 235/380
2011/0186629 A1 * 8/2011 Stuck et al. ..... G06K 19/14 235/380
2011/0289888 A1 * 12/2011 Reichardt et al. ..... A61J 1/03 53/473
2012/0228190 A1 9/2012 Yun et al.
2013/0008825 A1 * 1/2013 McArthur et al. ..... B65B 9/045 206/531
2013/0081924 A1 * 4/2013 Baroncini ..... G06K 19/14 235/380
2013/0133489 A1 * 5/2013 Este et al. ..... G06Q 10/087 380/55
2014/0230376 A1 * 8/2014 Knoth ..... G06Q 10/087 380/55
2016/0001948 A1 1/2016 Collins et al.
2017/0253353 A1 * 9/2017 Kohl ..... G06Q 10/08 235/494

FOREIGN PATENT DOCUMENTS

EP 0210823 A1 2/1987
EP 0257990 A2 3/1988
EP 0849055 A1 6/1998
EP 1985550 A1 * 10/2008 ..... B65B 9/045
EP 2272763 A1 1/2011
EP 2383705 A1 11/2011
GB 2184086 A 6/1987
WO 02/00161 A1 1/2002
WO 0200161 A1 1/2002
WO 2007/093844 A1 8/2007
WO 2009000261 A1 12/2008
WO 2014/130941 A2 8/2014
WO 2014130941 A2 8/2014

OTHER PUBLICATIONS

English Abstract of EP 2383705 A1 published Nov. 2, 2011.
Notice of Reasons for Refusal in corresponding Japanese Patent Application No. 2018-510434 dated Sep. 14, 2020 (pp. 1-7).

* cited by examiner

MACRO BLISTER PACKAGING

The present invention relates to a new type of blister pack containing medicinal product portions, a method for production of said blister pack, a method for providing medicinal product portions for patients, and a system for producing packed medicinal product portions, which are intended to be passed on to patients.

Blister pack packaging is the preferred packaging for medicinal product portions, such as tablets and capsules. In a blister pack the tablets or capsules are provided in an arrangement consisting of individual recesses (cavities) in a plastic film or aluminium foil. The cavities are usually sealed by an aluminium foil. The medicinal product portions are can be individually removed and are protected against dirt and air moisture. A further advantage of medicinal product portions in blister pack packaging lies in the easy identification of the remaining number of available medicinal product portions.

Blister pack packaging, devices for production thereof, and devices for packaging medicinal product portions in blister pack packaging are described sufficiently in the prior art (see, for example, U.S. Pat. No. 4,384,649A, GB2184086A, EP2272763A1, EP0849055A1, EP0257990A2, EP0210823A1, DE3803979A1, and CN203003955U).

A typical size of a blister pack is illustrated in FIG. 1*a* of the laid-open application GB2184086A: 15 individual medicinal product portions are provided in a planar arrangement of approximately 6-8 cm×4-6 cm.

Blister packs are typically introduced into yet a further packaging before being passed on to the patient. This secondary packaging is typically a folding box which, besides a number of approximately 1 to 10 blister packs, usually also contains a package leaflet containing use and safety information.

Current production systems for packaging medicinal product portions are subjected to increasing pressure for change: more and more medicinal products are being developed for particular indications, and there are specific administration forms and dosages. Country-specific requirements on the approval of the medicinal products additionally require special packaging, package leaflets and imprints. Furthermore, packaged medicinal products, for approval reasons, cannot be stored over an arbitrary period of time.

All of these factors lead to a decreasing batch size. The currently used packaging facilities, which are designed for large batch sizes, cannot follow this trend fully. This is due, in particular, to the high set-up outlay required for a change of product and/or format, which therefore quickly makes small batches uneconomical.

There is thus a need for a solution in accordance with which the described pressure for change can be met in the current production systems for packaging of medicinal product portions.

This problem is solved in accordance with the invention in that the process of the primary packaging, secondary packaging and marking of medicinal product portions is separated into two areas. In the first area, what are known as macro blister packs are produced, which contain a multiplicity of medicinal product portions. These macro blister packs do not contain and/or carry any country-specific and/or customer-specific information. They constitute an intermediate stage, in which the medicinal product portions can be transported and stored. In the second area, secondary-packaged and marked medicinal products are produced from the macro blister packs, these medicinal products being suitable for being passed on to specific customers/patients, for example in a particular country. They contain or carry all country-specific and/or customer-specific markings, package leaflets, warnings, etc. that are necessary.

As a result of this separation according to the invention, it is possible to produce medicinal product portions as before in large batch sizes and to package these in primary packaging. However, the packaged medicinal product portions, in order to be passed on to customers/patients, are prepared differently than before and separately, both physically and temporally, from the production of the macro blister packs, more specifically at a moment in time and/or at a location at which there is more precise knowledge as to how many medicinal product portions are required for what purpose.

Due to the production of the macro blister packs, the medicinal product portions are brought into a state allowing maximum flexibility in view of the subsequent use (location, time and purpose). Due to the separation according to the invention of the previous process, costs can be reduced at the same time, since excess capacities can be avoided on account of the flexible use of the macro blister packs. In addition, small batch sizes can also be produced effectively and at reduced cost.

WO02000161 describes a method in which conventional blister packs are first packed and stored unlabelled in order to be unpacked again at a later moment in time, labelled, and packed again, before they are supplied to their final destination. Because the blister packs are only provided with information when their final destination is known, the blister packs can be handled in a flexible manner. However, the method described in WO02000161 is comparatively laborious due to the steps of packing, unpacking and renewed packing. The handling of the comparatively small conventional blister packs also requires complex technical solutions. These disadvantages are not encountered by the present invention.

A first subject matter of the present invention is thus constituted by macro blister packs that allow a more flexible and/or more economical packaging and provision of medicinal product portions.

A macro blister pack in the sense of the present invention is characterized in that it is larger than the blister packs passed on to patients. A macro blister pack is divided into smaller units only at a later moment in time. These smaller blister pack units are passed on to customers/patients. They will also be referred to hereinafter as ready-for-use blister packs.

A blister pack packaging is understood to mean a composite of flat film layers that cover one another and are connected to one another. One of the film layers forms what is known as the base. It has at least one recess or open "bubble", which can receive a medicinal product portion. A second film layer, which is referred to as the cover, serves to seal the bubble.

A blister pack is understood to mean a blister pack packaging that has at least one bubble, this bubble being filled with a medicinal product portion and sealed.

FIG. 1 shows an example of a ready-for-use blister pack.

FIGS. 2 and 3 show examples of a macro blister pack.

A macro blister pack according to the invention can contain punched portions, notches, perforations or the like in order to facilitate mechanical preparation and processing.

In a preferred embodiment the macro blister pack according to the invention has markings, which for example specify where it can be/is to be later divided. These markings are preferably machine-readable markings. Fold lines, punched regions, perforations, notches, printed lines, milled grooves, and many more are conceivable markings.

A macro blister pack in the sense of the present invention contains a number T of at least 60 medicinal product portions.

A medicinal product portion is understood to mean a fixed administration form of a medicinal product, which administration form can be taken by a patient as an individual unit. Examples of medicinal product portions are tablets, pills, lozenges and capsules.

In a preferred embodiment of the present invention, the macro blister pack contains at least 100 medicinal product portions.

In a preferred embodiment of the present invention, the macro blister pack contains at least 150 medicinal product portions.

In a preferred embodiment of the present invention, the macro blister pack contains at least 200 medicinal product portions.

In a particularly preferred embodiment of the present invention, the macro blister pack contains between 250 and 350 medicinal product portions.

In a particularly preferred embodiment of the present invention, the macro blister pack contains a number of medicinal product portions which corresponds to the number of ready-for-use blister packs into which it will be divided at a later point in time.

The macro blister pack according to the invention has a planar extent in the range from 200 mm×200 mm (0.04 $m^2$) to 1200 mm×1200 mm (1.44 $m^2$).

In a further preferred embodiment, the macro blister pack according to the invention has a planar extent of at least 0.09 $m^2$.

In a particularly preferred embodiment, the macro blister pack according to the invention has a planar extent in the range from 0.1225 $m^2$ to 0.96 $m^2$.

The macro blister pack according to the invention can, in principle, have any desired shape, for example can be round, hexagonal, quadrangular or triangular. It can be symmetrical or asymmetrical. Shapes that simplify mechanical preparation and/or processing are advantageous. The macro blister pack therefore preferably has a rectangular shape, where the corners, however, can be rounded (see the macro blister packs of FIGS. 2 and 3, by way of example).

In a further preferred embodiment, the macro blister pack has a planar extent that is suitable for placing an individual macro blister pack or two, three or four macro blister packs adjacently on a transport pallet so that the base area of the transport pallet is practically completely filled, without any of the macro blister packs protruding beyond the outer edges of the transport pallet.

A preferred transport palette is the Europallet. A Europallet is understood to mean the transport pallet standardized by EN 13698-1 having a base area of 1200 mm×80 mm.

Further preferred transport pallets are chemistry pallets (see "CP—Paletten für die Chemische Industrie" Handbuch für Verpackungen ("Chemical Industry Pallets—CP" Packaging Handbook). VCI—Verband der Chemischen Industrie e.V. (German Chemical Industry Association), April 2004, $6^{th}$ edition.

With regard to the Europallet, the macro blister pack thus has, by way of example, a planar extent in the range from 1000 mm×700 mm (0.7 $m^2$) to 1199 mm×799 mm (0.958001 $m^2$), such that an individual macro blister pack practically fills the base area of the Europallet.

In another possible embodiment, the macro blister pack has a planar extent in the range from 500 mm×700 mm (0.35 $m^2$) to 599 mm×799 (0.478601 $m^2$) or a planar extent from 1000 mm×350 (0.35 $m^2$) mm to 1199 mm×399 mm (0.478401 $m^2$), such that two adjacently placed macro blister packs practically completely fill the base area of the Europallet.

In another possible embodiment, the macro blister pack has a planar extent in the range from 333 mm×700 mm (0.2331 $m^2$) to 399 mm×799 mm (0.318801 $m^2$) or a planar extent from 1000 mm×233 mm (0.233 $m^2$) to 1199 mm×266 mm (0.297654 $m^2$), such that three adjacently placed macro blister packs practically completely fill the base area of the Europallet.

In another possible embodiment, the macro blister pack has a planar extent in the range from 250 mm×700 mm (0.175 $m^2$) to 299 mm×799 (0.238901 $m^2$) mm or a planar extent from 1000 mm×175 mm (0.175 $m^2$) to 1199 mm×199 mm (0.238601 $m^2$), such that four adjacently placed macro blister packs practically completely fill the base area of the Europallet.

Similar dimensions can also be determined for other transport pallets.

A plurality of macro blister packs according to the invention are usually stacked above one another and/or adjacently in order to be transported and/or stored. A further subject matter of the present invention is therefore a stack comprising at least 2 macro blister packs according to the invention. In a preferred embodiment, the stack comprises a number from 10 to 200 macro blister packs. In a further preferred embodiment, the stack comprises a number from 50 to 150 macro blister packs. In a further preferred embodiment, the stack comprises a number from 100 to 150 macro blister packs.

The individual macro blister packs can be stored in the stack above one another or adjacently such that the bubbles in which the medicinal product portions are disposed always point in one direction. However, it is also conceivable to provide a stacking in which the individual macro blister packs point alternately in one direction and then in another direction, as is shown by way of example in FIG. 4. The macro blister packs are preferably stacked alternately rear side to rear side and belly side to belly side, the belly side denoting the side on which the bubbles are arranged and the rear side denoting the side that is arranged opposite the belly side and that is flatter.

A macro blister pack according to the invention can have supporting structures, which lead to a stabilization during the stacking and/or which are intended to prevent bubbles from being pressed in during the stacking.

It is also conceivable for the macro blister packs according to the invention to be stored in transport boxes, which in turn can be adapted, in terms of their size, to transport pallets. A further subject matter of the present invention is a transport box containing macro blister packs. The transport box according to the invention preferably contains a stack of macro blister packs according to the invention.

A transport box is understood to mean a box-shaped body, of which a base surface and the adjoining four side surfaces enclose a volume for receiving the macro blister packs. A transport box according to the invention usually has a lid, with which the volume can be sealed in a reversible manner with respect to the external environment so that a material exchange between the volume and the external environment is prevented or, with respect to gaseous substances, is at least limited.

FIG. 5 shows an example of a transport box according to the invention.

In a preferred embodiment the transport box has a size from the 580 mm×200 mm×308 mm (0.035728 $m^3$) to 2320 mm×800 mm×1230 mm (2.28288 $m^3$).

As shown in FIG. 5(*b*) the transport boxes can also be stacked above one another and/or adjacently on a transport pallet.

A further subject matter of the present invention is a transport pallet, on which at least two transport boxes according to the invention are stored.

The transport boxes can have supporting structures and/or separation layers, in order to stabilize contained macro blister packs. The transport box preferably has a marking, such as a machine-readable optical code or an RFID chip, for determining the content. Is also conceivable to provide a transport box with GPS, GSM or other receivers/transmitters enabling localisation. A sealing is also conceivable.

The transport box may be provided with means for thermal and/or electrical insulation and/or with means for controlling the temperature of its content. Means which protect the content when it is dropped are also conceivable.

In a preferred embodiment, the macro blister pack according to the invention has a preferably machine-readable marking, via which information regarding the contained medicinal product portions can be obtained. More detailed information regarding machine-readable markings provided further below.

The macro blister pack according to the invention has free surfaces, which can be provided with country- and/or customer-specific information and markings. Country- and/or customer- and/or use-specific information and markings are applied to the macro blister packs or to the ready-for-use blister packs obtained from the macro blister packs, in accordance with the invention, only at a moment in time at which the location of use and purpose of the medicinal product portions have been determined. In a preferred embodiment, the macro blister pack according to the invention therefore has no country- and customer-specific information and markings.

A method for producing a macro blister pack is also a subject of the present invention. The method comprises the introduction of medicinal product portions into the cavities of a macro blister pack packaging and the subsequent sealing of the cavities. In an alternative embodiment the medicinal product portions are introduced into a blister pack web and the blister packs are then sealed. Following the sealing, the blister pack web is divided into the macro blister packs according to the invention. A blister pack web is understood to mean a film layer, in which bubbles for receiving medicinal product portions formed.

In a preferred embodiment, the method also comprises the application of at least one machine-readable marking to the macro blister pack. In a preferred embodiment, an optically machine-readable marking is applied, which is not visible to the naked human eye. Further information regarding machine-readable markings can be found in the text further below.

The macro blister packs according to the invention are usually produced in the vicinity of the production point for medicinal product portions. In many countries, certain quality assurance measures must be taken for the production and primary packaging of medicinal agents. Here, reference is made as keyword to the quality assurance guidelines known under the name of "good manufacturing practice" (GMP). A macro blister pack packaging usually constitutes the primary packaging of the medicinal product portions. Prior to their introduction into a macro blister pack packaging, the medicinal product portions are present in the form of unpackaged substances, the handling of which, in accordance with GMP guidelines, is subject to higher demands than the handling of the packaged portions in the form of the macro blister packs. In a preferred embodiment, the medicinal product portions are therefore introduced into the macro blister pack packaging directly following their production. Here, the term production comprises not only the production of the medicinal agents, but also the production of the administration form (for example tablet, capsule) from the medicinal agents (for example by means of tablet pressing, encapsulation, etc.).

The medicinal agents packaged in the macro blister packs can then be processed under less stringent conditions.

The macro blister packs produced in this way are stored until it is determined to which customers/patients the medicinal product portions are to be passed on. A use-specific marking is only then provided, the macro blister packs according to the invention are divided into a plurality of conventional blister packs (ready-for-use blister packs), and these ready-for-use blister packs are introduced into secondary packaging.

Secondary packaging is understood to mean a packaging into which one or more ready-for-use blister packs can usually be introduced together with a package leaflet. The secondary packaging containing one or more ready-for-use blister packs and preferably one or more package leaflets containing use information is the unit that a patient is given for use by a doctor, pharmacist, chemist or another distributor of medicinal products. Here, the term use is understood to mean the taking of one or more medicinal product portions for the treatment of an illness, for prophylaxis, for improvement of well being, for birth control, and the like.

It is also conceivable for the medicinal product portions in the secondary packaging to be intended for a hospital or a doctor, wherein the hospital staff or the doctor removes individual medicinal product portions from the secondary packaging in order to pass these on to patients.

The secondary packaging is usually a folding box, preferably made of card. FIG. 6 shows a few examples of secondary packaging containing a plurality of ready-for-use blister packs.

The provision of medicinal product portions in macro blister packs is a further subject of the present invention.

The invention therefore also relates to a method for providing medicinal product portions for one or more patients, comprising the following steps (A) producing a macro blister pack containing medicinal product portions, (B) storing the macro blister pack, (C) dividing the macro blister pack into a number N of ready-for-use blister packs, where N is an integer greater than 8, (D) introducing a number n of ready-for-use blister packs from step (C) into a secondary packaging, wherein n is an integer greater than or equal to 1.

In step (A) of the method according to the invention a macro blister pack is produced by introducing medicinal product portions into the cavities of a macro blister pack packaging and then sealing the cavities. Each medicinal product portion is usually sealed in one cavity. For this purpose, the known devices for introducing medicinal product portions into conventional blister packs are used, the devices having to be adapted to the size of the macro blister pack where appropriate. An adaptation of this type is a routine activity for a person skilled in the art of mechanical engineering.

Is also conceivable for medicinal product portions to be introduced into blister pack webs, from which macro blister packs are then produced by cutting, punching or similar separation methods.

In step (B) the macro blister packs thus produced are stored until it is determined where and for what purposes the medicinal product portions are to be used. Here, the store can be situated at the location at which the macro blister packs have been produced. However, the store can also be situated at the location at which the macro blister packs have been divided into ready-for-use blister packs. Storage at a location corresponding neither to the site of production of the macro blister packs nor to the site of division is also conceivable.

For example, one or more stores in which the macro blister packs according to the invention, stacks of macro blister packs, transport boxes and/or transport pallets are held ready in the vicinity of possible sites of use ("central stores") is/are conceivable. A central store of this type is a further subject of the present invention. A combination of one or more central stores and stores at the locations of production of the macro blister packs and/or of the division of the macro blister packs is also conceivable Here, a store is not just intended to mean a storage space or a warehouse. A store can also be a mobile store, such as a container.

The above-described transport box in which the macro blister packs are not further processed for a period of time can also be understood as a store. What is key is that medicinal agents are retained in a flexible state in the form of a macro blister pack, which makes it possible to produce differently packaged and labelled medicinal agents for different uses, countries, regions, markets, clients and/or the like, as necessary.

In a preferred embodiment the method according to the invention comprises the additional step of transporting the macro blister packs from the location of production of the macro blister packs (step (A)) to the location of the division of the macro blister packs (step (C)). The transport does not have to occur directly between these locations; it is conceivable for the macro blister packs to be transported initially from the location of production of the macro blister packs to a store and then to be transported on, at a subsequent moment in time, from this store to the location of the division.

In step (C) the macro blister packs are divided into a number N of ready-for-use blister packs.

A macro blister pack can be divided into a number N of ready-for-use blister packs using known methods. For example, laser cutting, mechanical cutting, punching, etching, electron beam machining, ultrasound and water jets are conceivable. These and further methods are described for example in DIN standards 8588, 8589 and 8590.

The division can be performed either manually or in an automated manner. A combination of manual and automated steps is also conceivable.

In a preferred embodiment of the method according to the invention, the number N of ready-for-use blister packs into which a macro blister pack is divided is at least 10.

In a particularly preferred embodiment of the method according to the invention, the number N of ready-for-use blister packs into which a macro blister pack is divided is at least 20.

In a further particularly preferred embodiment of the method according to the invention, the number N of ready-for-use blister packs into which a macro blister pack is divided is precisely the number T of medicinal product portions in the macro blister pack. Each ready-for-use blister pack thus contains precisely one medicinal product portion (see FIG. 6(*a*), for example). A blister pack of this type will also be referred to hereinafter as an individual blister pack. With an individual blister pack of this type, it is possible, for example, for a patient to carry with them an individual medicinal product portion in packaged form so as to be able to take this as required. It is not necessary for the patient to carry with them a conventional ready-for-use blister pack containing a plurality of medicinal product portions, although only an individual medicinal product portion is generally used. The risk of the ready-for-use blister pack and the medicinal product portions contained therein becoming damaged or lost is thus reduced.

In a hospital, the hospital staff often give patients individual, unpackaged medicinal product portions in small containers in order to take these medicinal product portions. It is conceivable that mix-ups could occur here. It is also conceivable that a container of this type is accidentally spilled and the content falls onto the floor. It is conceivable that the spilled medicinal product portions therefore can no longer be used for hygiene reasons. However, it is also conceivable that the spilled medicinal product portions can no longer be assigned to the patient.

The ready-for-use blister packs containing only an individual medicinal product portion are therefore advantageous, since medicinal product portions can be given to a patient in packaged form.

Furthermore, mechanically produced individual blister packs have an important advantage over ready-for-use blister packs that contain a perforation so that the customer themself can separate off individual blister packs: the mechanically produced individual blister packs can be produced such that they have no sharp corners or edges, whereas sharp corners and edges are usually produced inevitably by tearing along a perforation.

In a further preferred embodiment the ready-for-use blister packs do not have any sharp corners or edges. A sharp corner or edge is understood to mean a corner or edge with which a conventional, inflated balloon can be burst by striking the corner or edge, from below, against the balloon, which is in the air.

In a further preferred embodiment a ready-for-use blister pack contains precisely one dosage. A dosage is understood to mean the dose of a drug that is to be administered within the scope of a therapy. The dose denotes the amount of an agent supplied to an organism. The dosage is usually exactly one medicinal product portion. However, there are also medicinal agents with which a dosage comprises a plurality of medicinal product portions. By way of example, it is conceivable that a medicinal product portion would be too large to comprise a dosage. In order to facilitate the taking of the medicinal agent, for example by swallowing, the dosage is distributed into a number of medicinal product portions. For example, two, three, four, five or six medicinal product portions per dosage are conceivable.

A further subject matter of the present invention is a stack-like arrangement of individual blister packs. A stack of this type comprises at least two individual blister packs. The individual blister packs are stacked in the stack above one another or adjacently. Here, the stacking can be performed such that the bubbles always point in the same direction or the individual blister packs are arranged alternately rear side to rear side and belly side to belly side. Additional supporting structures, which can be mounted beside the bubbles, are intended to prevent the bubbles from being pressed in and/or damaged. FIG. 6(*b*) shows preferred embodiments of individual blister pack stacks. In a preferred embodiment, a stack according to the invention is situated in a secondary packaging, which in the lower region has an opening, through which an individual blister pack can be removed from the secondary packaging, wherein the individual blister packs arranged above one another move down as a result of the force of gravity. An embodiment of this type is illustrated by way of example in FIG. 6(*a*) (left-hand side, the secondary packaging bears the inscription 28).

In step (D) the ready-for-use blister packs are introduced into secondary packaging. Here, a secondary packaging contains at least one ready-for-use blister pack. The number n of ready-for-use blister packs that are introduced into a secondary packaging is usually between 1 and 200.

A ready-for-use blister pack contains at least one medicinal product portion. Typical quantities of medicinal product portions per ready-for-use blister pack are 1, 2, 3, 4, 5, 6, 7, 8, 9, 10, 12, 14, 16, 18, 20, 21, 28, 30, 31, 32, 64, 50 and 100. Other quantities, however, are also conceivable.

The ready-for-use blister pack from step (C) has a size dependent on the number of contained medicinal product portions. A base area of at least 35 mm×35 mm (12.25 $cm^2$) is usually estimated for each individual medicinal product portion, as is illustrated in FIG. 7.

The method according to the invention offers the advantage that large batch sizes of packaged medicinal products can be produced, as previously, but that the use of macro blister packs allows a greater flexibility in the further preparation and/or processing and in the further logistics.

Only once the intended purpose and the location at which the medicinal product portions are to be used have been determined are said medicinal product portions brought into their final form intended for the customer/patient.

In a preferred embodiment, the macro blister packs are produced in one country or state and are divided in another country or state.

In a particularly preferred embodiment, the macro blister packs are produced in the country or state in which the medicinal product portions are also produced.

In a further particularly preferred embodiment, the macro blister packs are divided in the country or state in which the blister packs are intended to be passed on to the patient.

It is also conceivable, however, for the macro blister packs to be produced at the same site at which the division and packaging into secondary packaging also take place. In such a case, the macro blister packs can be produced and stored in advance. The medicinal product portions are then labelled in a customer- and/or country-specific manner as necessary and brought into their final form.

It is conceivable to apply information to a macro blister pack packaging before, during or after said macro blister pack packaging is filled with medicinal product portions in step (A) of the method. According to the invention information concerning the medicinal product portions, the date of packaging, an expiry date, a batch number, the packaging location, and other information is conceivable.

It is conceivable to apply information to the macro blister packs before they are stored in step (B) of the method according to the invention. Information concerning the medicinal product portions, the date of packaging, an expiry date, a batch number, the packaging location, and other information is conceivable.

It is conceivable to apply information to the macro blister packs following the storage and step (B) and prior to the division in step (C) of the method according to the invention. Information concerning the medicinal product portions, the date of packaging, an expiry date, a batch number, the packaging location, and other information is conceivable.

It is conceivable to apply information to the ready-for-use blister packs produced in step (C). Information concerning the medicinal product portions, the date of packaging, an expiry date, a batch number, the packaging location, and other information is conceivable.

Country- and/or client-specific information is applied to the ready-for-use blister packs or the regions of the macro blister packs from which the ready-for-use blister packs are produced by division, in accordance with the invention, only directly before and/after the division of macro blister packs.

In a preferred embodiment, the method according to the invention comprises a step in which country- and/or customer-specific information is applied to the macro blister pack, this step following step (B).

Information can be applied to a macro blister pack and/or a ready-for-use blister pack by means of methods as are usual in the labelling of blister packs. Examples include inkjet printing, laser marking, pad printing, and the introduction of structures, such as braille lettering.

In a preferred embodiment of the present invention, the macro blister pack is provided with at least one machine-readable code. Examples of machine-readable codes are RFID codes or optical codes, such as stacked codes (for example Codablock, Code 49 or PDF417), matrix codes (for example QR code, DataMatrix, MaxiCode or Aztec code) and dot codes. An optical two-dimensional code, such as the matrix code, is preferably used, and particularly preferably a DataMatrix code.

In a preferred embodiment a code is applied to the macro blister pack per medicinal product portion, such that each individual medicinal product portion is labelled. This allows the individual recognition and tracking of each individual medicinal product portion on its way from the macro blister pack via the ready-for-use blister, possibly via a doctor, pharmacist and/or a hospital, to the patient. It is also possible, as a result of this labelling, to track and to verify the identity of the medicinal substance up to the moment at which a patient presses the medicinal product portion from the ready-for-use blister pack.

Individual markings are advantageous in particular for personalized medicine.

FIG. 8 shows how an individual medicinal product portion in a blister pack (both macro blister packs and ready-for-use blister packs) can be provided with an individual marking. It is also conceivable to apply the marking to the rear side. An application of a marking to the belly side and the rear side is also conceivable.

In a further preferred embodiment each of the N regions on the macro blister pack from which a ready-for-use blister pack is generated during the division in step (C) receives an individual marking. In a further preferred embodiment, the macro blister pack is provided with at least one marking, which is not visible to humans with the naked eye in visible light (electromagnetic radiation of a wavelength from 380 nm to 780 nm). This marking can be applied to both sides of the macro blister pack. A marking is preferably applied to the belly side of the blister pack, whereas, for example, a legible marking is applied to the opposite rear side at a later moment in time.

For the "invisible" marking, inks can be used, for example, which can be made visible only in ultraviolet light (electromagnetic radiation of a wavelength from 10 nm to less than 380 nm).

An invisible marking of this type has the advantage that it can be read by machines and the macro blister packs can thus be processed, without the marking influencing the further sequence of the production of the ready-for-use blister packs, packaging thereof in a secondary packaging, and forwarding to a hospital, a doctor, a pharmacist and/or a patient. Since it is cannot be seen by a human with the naked eye, it also does not provide any further "disturbance" and can be, for example, printed over or adhered over with legible information at a later moment in time, when it is no longer of any use.

The invisible marking thus serves, in an embodiment of the present invention, primarily for the processing of the macro-blister packs.

In a preferred embodiment a macro blister pack is provided on the belly side with an optically machine-readable marking in each of the regions from which the ready-for-use blister packs are produced, the marking being invisible to the naked human eye.

A further subject matter of the invention is a system for producing packaged medicinal product portions intended to be passed on directly to patients, said system comprising (A) an apparatus for producing a macro blister pack, (B) a store for storing the macro blister pack, (C) an apparatus for dividing the macro blister pack into a number N of ready-for-use blister packs, where N is an integer greater than 8, (D) an apparatus for introducing a number n of ready-for-use blister packs into a secondary packaging, wherein n is an integer greater than or equal to 1.

The term "apparatus" is used here synonymously with the term "device". An "apparatus" is a device that has appropriate means for carrying out the method, said means characterizing the apparatus. For example, an "apparatus for introducing medicinal product portions into a micro blister pack packaging" is a device that has means for introducing medicinal product portions into a macro blister pack packaging. An apparatus can have a plurality of mechanical units that perform different processes, such as gripping, transporting, filling, printing, cutting, etc.

The system according to the invention comprises an apparatus for producing a macro blister pack. As described above, a macro blister pack can be produced by introducing medicinal product portions into the bubbles of a blister web, sealing the bubbles, and separating off a macro blister pack from the blisters web. A macro blister pack can also be produced by firstly separating off a sheet from a blister pack web, filling the bubbles of the sheet with medicinal product portions, and sealing the bubbles. The apparatus (A) according to the invention has the corresponding functions for carrying out the specified steps.

In an embodiment of the present invention, the apparatus for producing the macro blister pack and the apparatus for dividing the macro blister pack are provided at locations physically separated from one another.

Physical separation is understood to mean that the apparatuses in question are no longer part of an individual production site or packaging site, but belong to different production sites/packaging sites. By way of example, the apparatus from step (C) is situated more than 100 km from the apparatus of step (A). By way of example, the apparatus of step (C) is situated in a different country/state compared with the apparatus of step (A).

The apparatuses of steps (C) and (D) are usually situated in the same country/state and preferably also at the same site.

The store specified in step (B) can be situated at the site at which the apparatus of step (A) is situated. It is also conceivable for the store in step (B) to be situated at the site at which the apparatus of step (C) is situated.

It is also conceivable for a store to be situated at the site at which step (A) is carried out, and for a further store to be situated at the site at which step (C) is carried out. A central store, a mobile store, or a combination of different stores, as discussed further above, is also conceivable.

In a preferred embodiment, the system according to the invention comprises means for transporting the macro blister pack from step (A) from the site where step (A) has taken place or from the site of the store from step (B) to the site where step (C) takes place.

Apparatuses for introducing medicinal product portions into a blister pack packaging are known. It is conceivable to use apparatuses of this type in the system according to the invention and in the method according to the invention. An adaptation to the size of the macro blister packs according to the invention might be necessary, however this can be easily implemented by a person skilled in the art of mechanical engineering.

Apparatuses for dividing blister packs are also known. It is conceivable to use devices of this type in the system according to the invention and in the method according to the invention. It may be that an adaptation to the size of the macro blister pack according to the invention is necessary, however this can be easily implemented by a person skilled in the art of mechanical engineering.

In a further preferred embodiment, an apparatus for applying country- and/or customer-specific information to a macro blister pack and/or to a ready-for-use blister pack is a further subject of the system according to the invention. This apparatus is preferably situated at a site different from that where the apparatus for producing the macro blister pack is situated.

The invention will be explained hereinafter by further examples, wherein the invention is not limited to the examples.

BRIEF DESCRIPTION OF THE DRAWINGS

In FIG. 3, cutting lines 4*a* and 4*b* are shown by way of example, which indicate where the macro blister pack can be divided in order to obtain a plurality of "conventional" blister packs (ready-for-use blister packs), which are intended to be passed on to patients.

FIG. 6(*b*) shows preferred embodiments of stacked individual blister packs. The individual blister packs have a flat main body (1), in which a bubble (2) is formed, in which a medicinal product portion is contained (not visible in FIG. 6(*b*)). In addition, supporting structures in the form of supporting ribs (5) or supporting nubs (6) are provided. Furthermore, each individual blister pack carries a machine-readable optical two-dimensional code (7). The left and middle stacks each contain 4 individual blister packs, which are arranged above one another such that the bubbles point in the same direction (upwardly in this case). In the right stack, four individual blister packs are stacked alternately rear side to rear side, belly side to belly side.

Figure 1B:
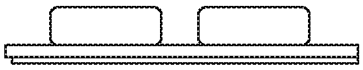
FIG. 1 shows an example of a ready-for-use blister pack a) in plan view, b) from the front, and c), d) from the sides. The ready-for-use blister pack comprises a flat body 1, in which cavities 2 for receiving medicinal product portions are formed. Individual medicinal product portions (not visible in FIG. 1) are situated in the cavities. The cavities are sealed by a film 3.
Figure 1C:
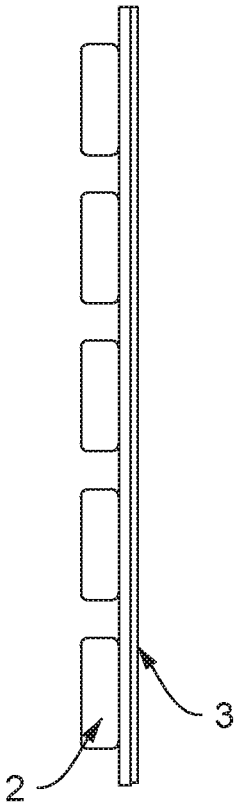
Figure 1A:
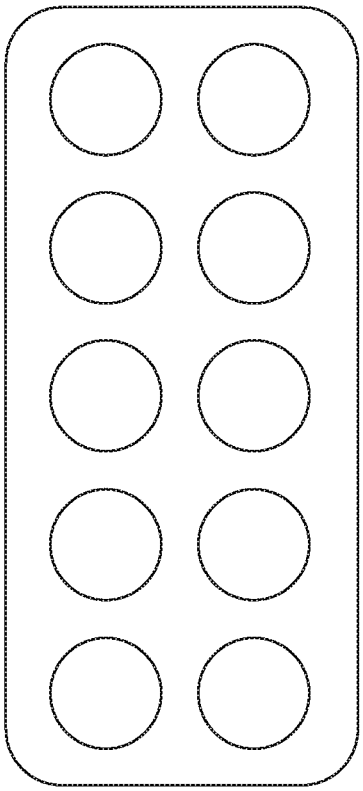
Figure 1D:
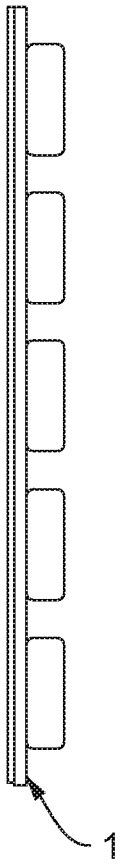
Figure 2B:
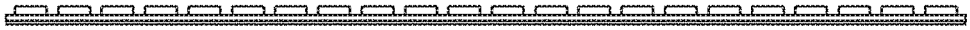
FIG. 2 shows an example of an embodiment of a macro blister pack a) in plan view, b) from the front, and c) in a side view. The macro blister pack comprises a flat body 1, in which cavities 2 for receiving medicinal product portions are formed. Individual medicinal product portions (not visible in FIG. 2) are situated in the cavities. The cavities are sealed by a film 3.
Figure 2A:
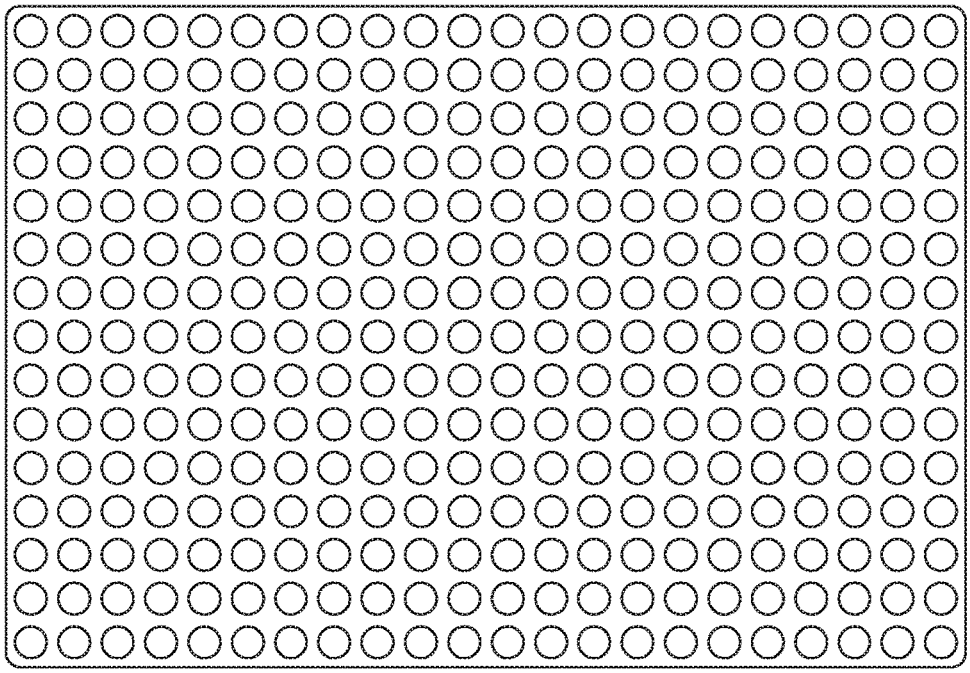
Figure 2C:
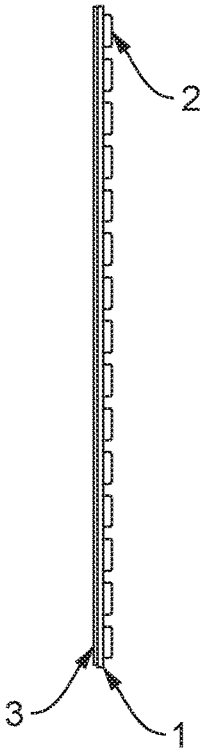
Figure 3B:
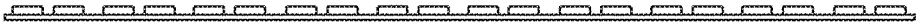
FIG. 3 shows a further example of an embodiment of a macro blister pack a) in plan view, b) from the front, and c) in a side view.
Figure 3A:
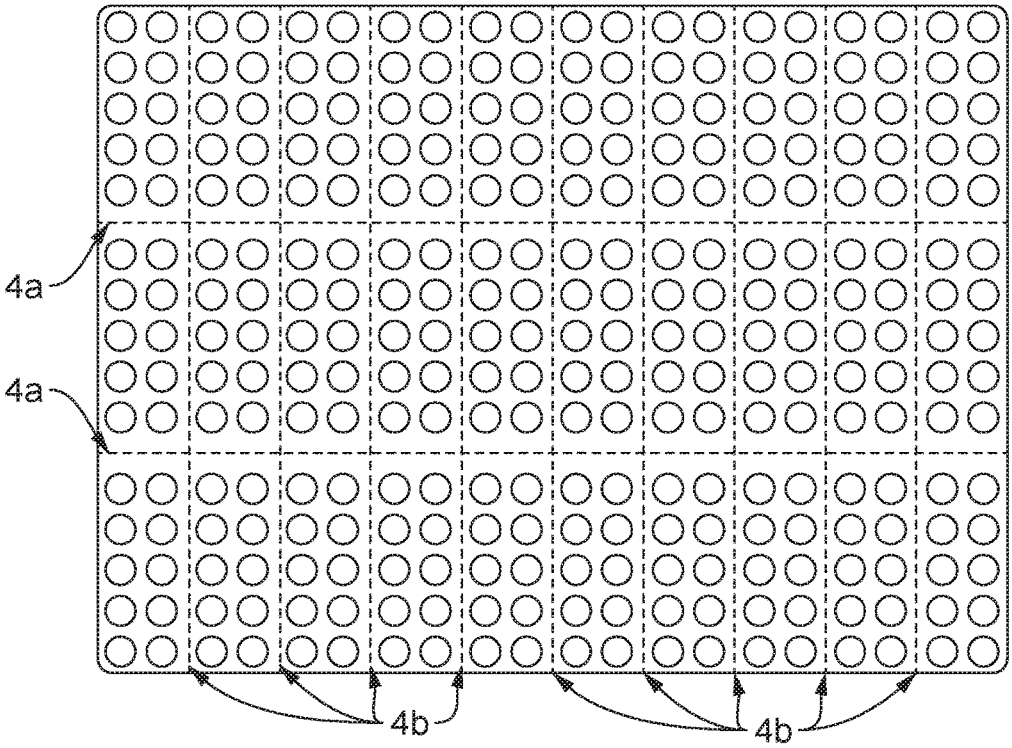
Figure 3C:
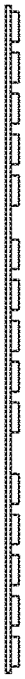
Figure 4:
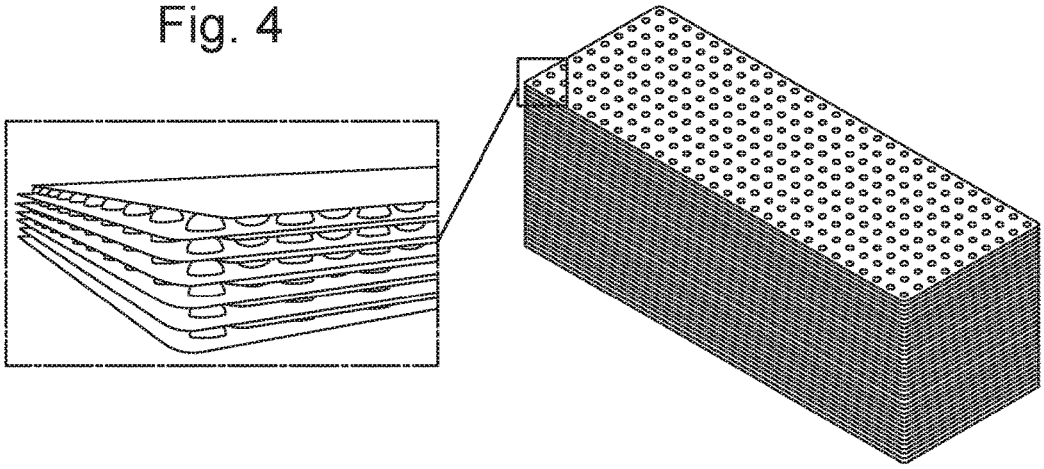
FIG. 4 shows a stack of macro blister packs according to the invention. The macro blister packs are stacked alternately back-to-back and belly-to-belly.
Figure 5A:
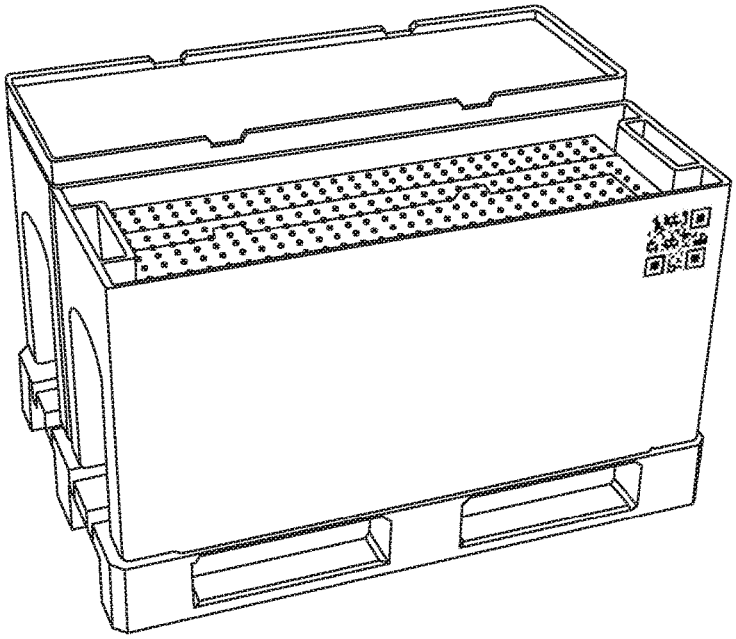
FIG. 5 shows an example of a transport box according to the invention. The transport box is formed such that two transport boxes can be placed adjacently on a Europallet, such that the base area of the Europallet is practically completely covered. The size of the transport box is approximately 1160 mm×400 mm×615 mm (0.28536 $m^3$). Between 100 and 150 macro blister packs can be stored in the transport box. When a macro blister pack contains 280 medicinal product portions, a total of 42,000 medicinal product portions per transport box are provided, in the case of 150 macro blister packs per transport box. Three Europallets each containing two transport boxes thus contain a total amount of 252,000 medicinal product portions.
Figure 5B:
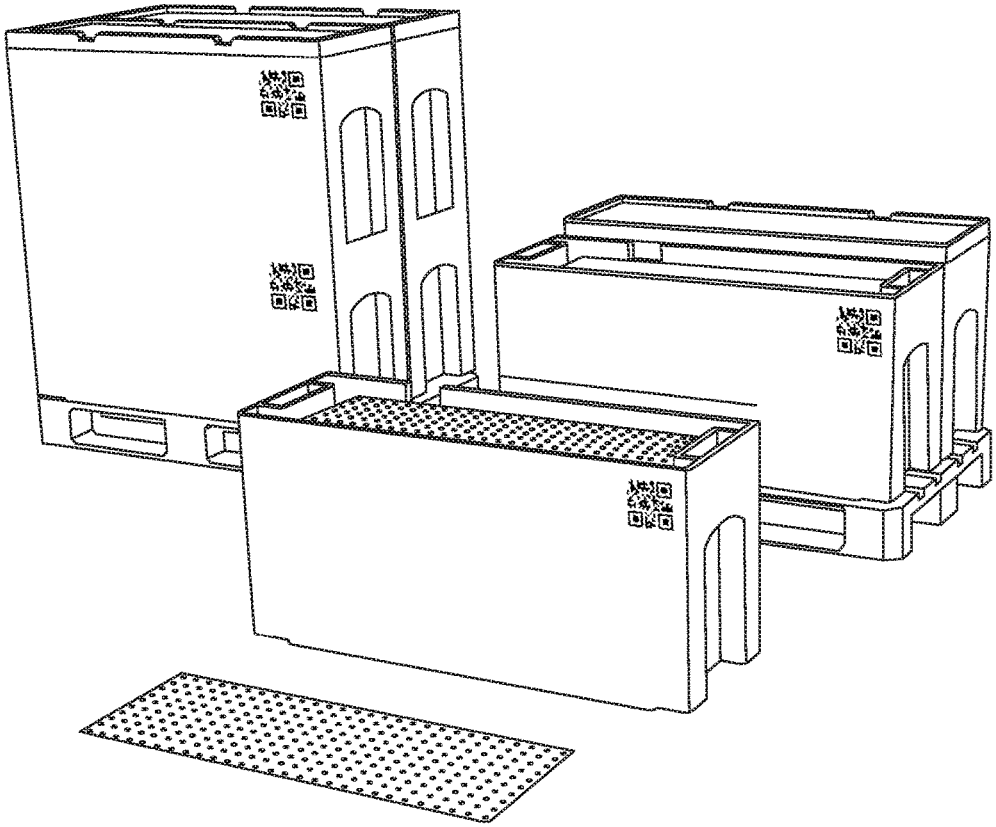
Figure 6A:
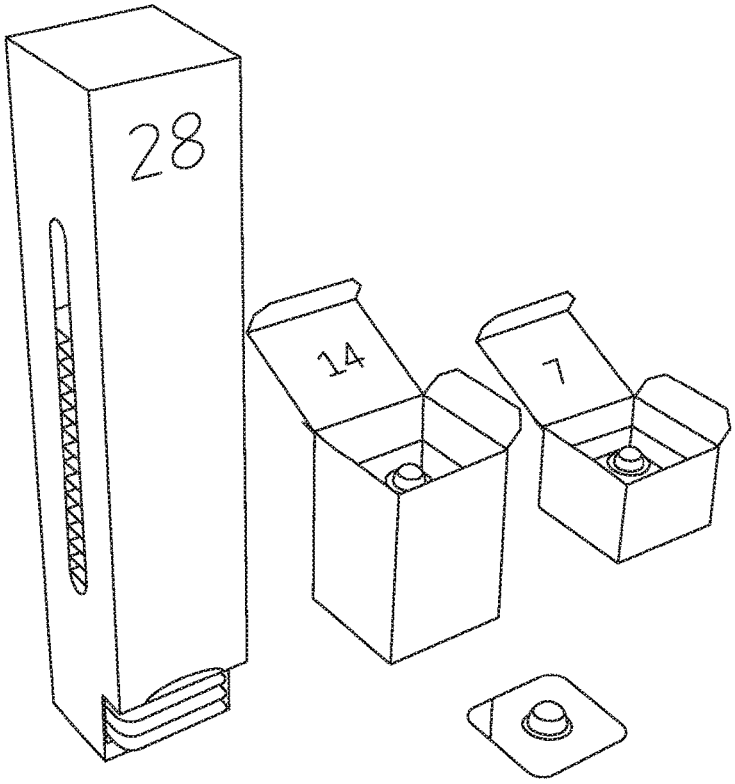
FIG. 6(*a*) shows some examples of secondary packaging containing a plurality of ready-for-use blister packs. In this example, each ready-for-use blister pack contains an individual medicinal product portion. There are 28, 14 and 7 ready-for-use blister packs/medicinal product portions contained in the secondary packaging, respectively.
Figure 6B:
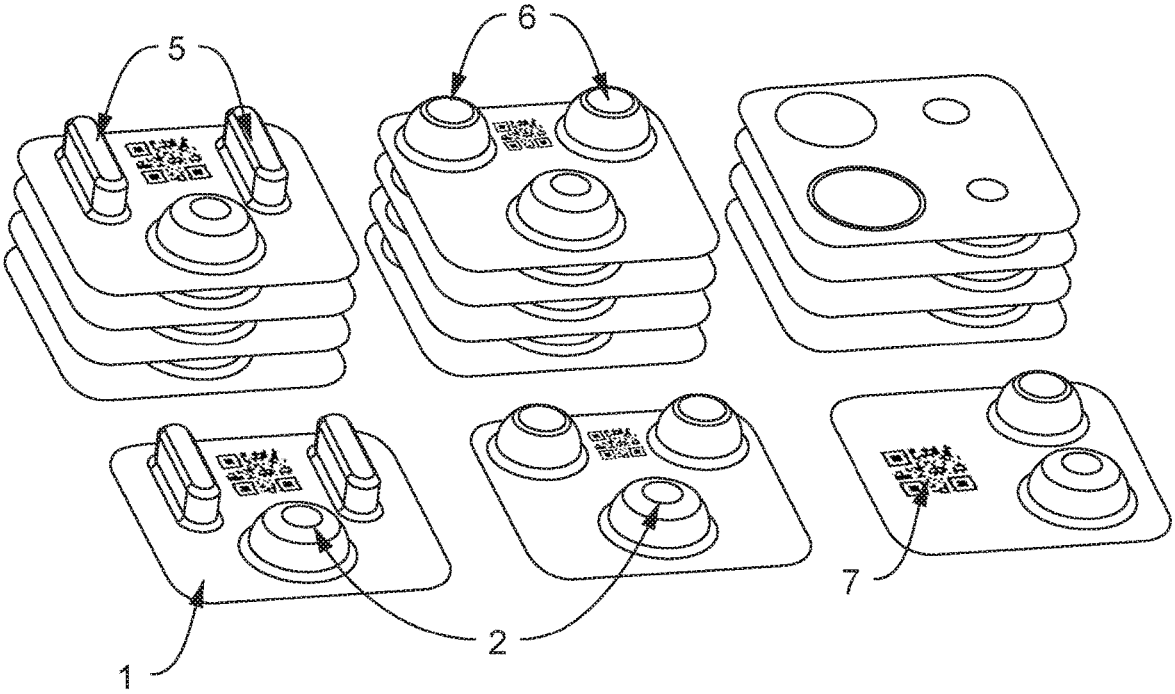
Figure 7:
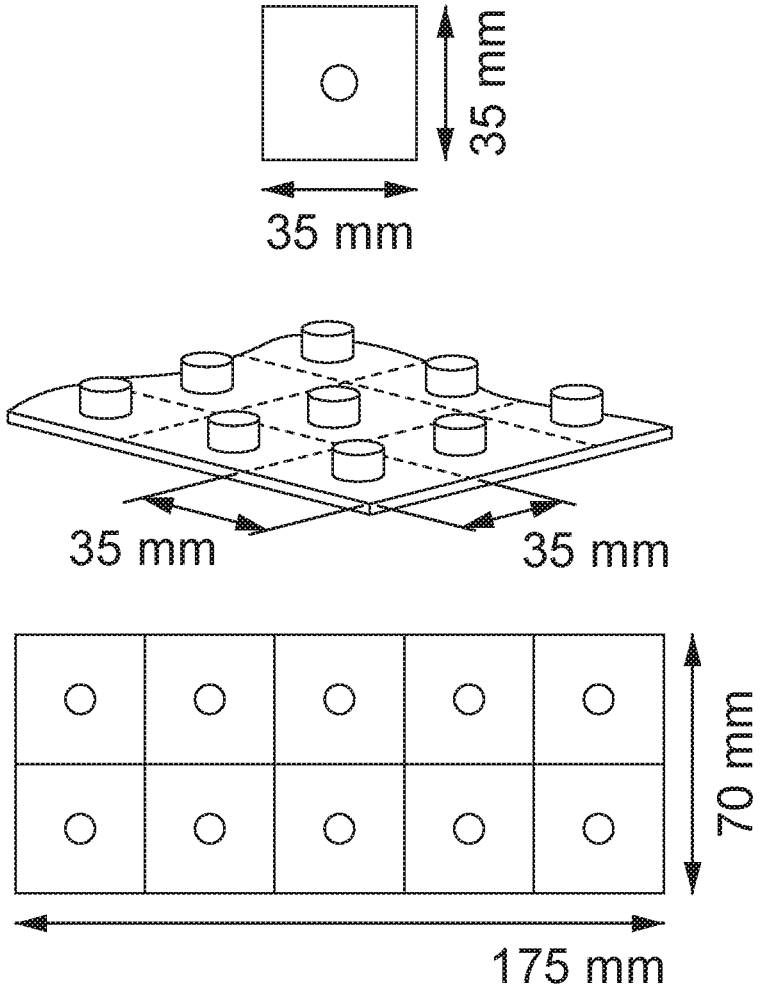
FIG. 7 shows schematically the area requirement of an individual medicinal product portion in a blister pack.
Figure 8:
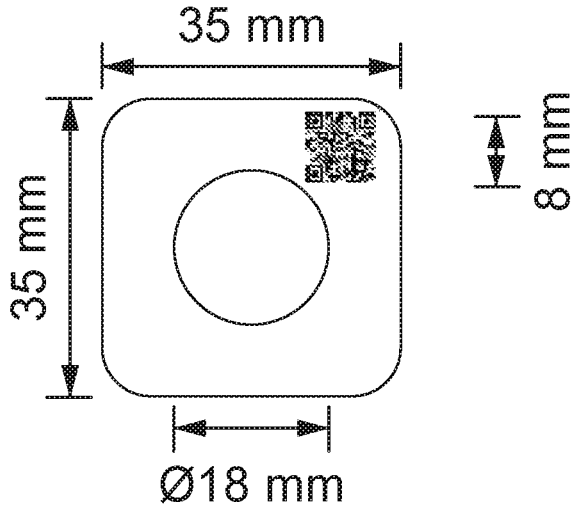
FIG. 8 shows a ready-for-use blister pack containing a medicinal product portion and carrying a matrix code on the belly side.
Figure 9:
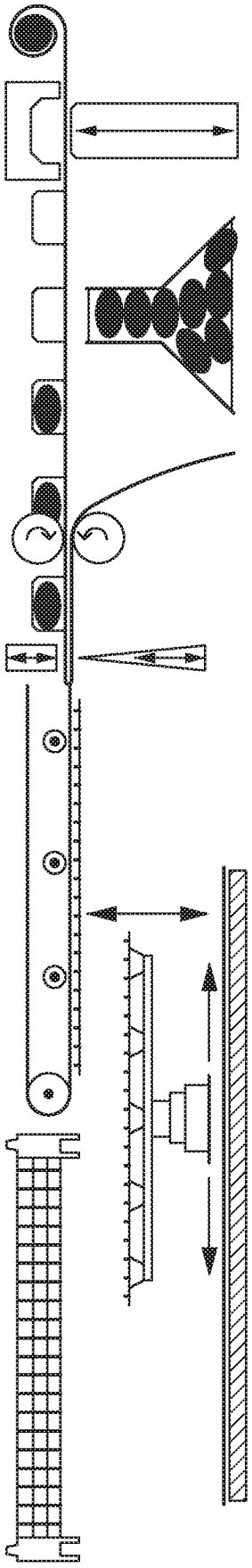
FIG. 9 schematically shows a device for producing macro blister packs. In the first step (to the left), individual medicinal product portions are introduced into cavities of a film layer, and the cavities are then sealed. The film composite is then cut into macro blister packs (middle), and the macro blister packs are transferred into transport boxes (to the right).
Figure 10:
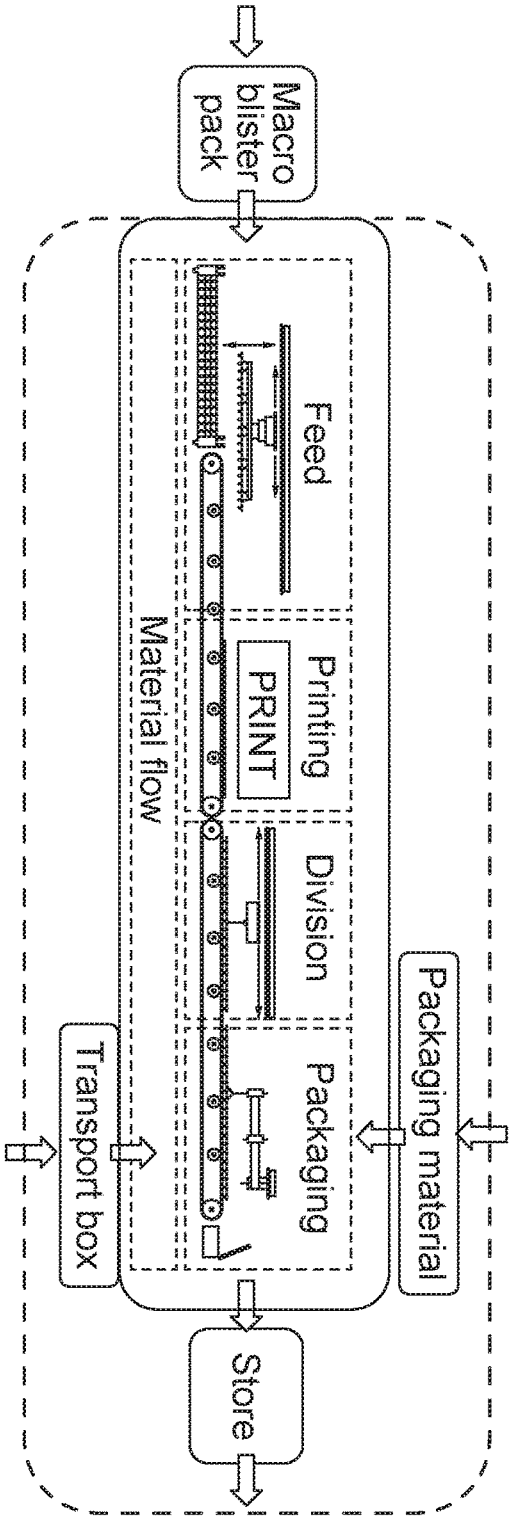
FIG. 10 schematically shows the processing of macro blister packs for producing ready-for-use blister packs. The macro blister packs are removed from the transport boxes (to the left). Information is printed on, then the macro blister packs are divided (middle). The ready-for-use blister packs produced in this way are packaged in the secondary packaging together with a package leaflet (to the right).

The invention claimed is:

1. Macro blister pack, comprising a flat body, in which cavities for receiving individual medicinal product portions are formed, the cavities being filled with individual medicinal product portions and sealed by a film, the macro blister pack containing a number T of medicinal product portions, characterized in that T is at least 60 and the flat body has an extent in the range from 200 mm×200 mm to 1200 mm×1200 mm and which has at least one machine-readable marking that specifies where said macro blister pack can be divided into smaller blister pack units.

2. Macro blister pack according to claim 1, which has no customer- and/or country-specific information.

3. Macro blister pack according to claim 1, which has a planar extent of at least 0.09 $m^2$.

4. Macro blister pack according to claim 1, which has a planar extent in the range from 0.1225 $m^2$ to 0.96 $m^2$.

5. Macro blister pack according to claim 1, which contains at least 100 medicinal product portions.

6. Macro blister pack according to claim 1, which contains between 250 and 350 medicinal product portions.

7. Macro blister pack according to claim 1, wherein the flat body has a rectangular shape.

8. Macro blister pack according to claim 7, wherein the flat body has rounded corners.

9. Macro blister pack according to claim 1, which has at least one machine-readable marking.

10. Macro blister pack according to claim 1, which has at least one machine-readable marking via which information regarding the contained medicinal product portions can be obtained.

11. Macro blister pack according to claim 1, which has at least one machine-readable optical two-dimensional code, via which information regarding the contained medicinal product portions can be obtained and which is invisible to the naked human eye.

12. Macro blister pack according to claim 1, wherein each region in which the macro blister pack can be divided into smaller blister pack units has a machine-readable optical two-dimensional code.

13. Macro blister pack according to claim 1, wherein a machine-readable optical two-dimensional code is applied in regions near each contained medicinal product portion.

14. Stack comprising at least two of the macro blister packs according to claim 1.

15. Stack according to claim 14, comprising 10 to 200 macro blister packs.

16. Transport box containing at least one macro blister pack according to claim 1.

17. Transport pallet, on which at least one macro blister pack according to claim 1 is stored.

18. Transport pallet, on which at least one transport box according to claim 16 is stored.

19. Method for producing a macro blister pack according to claim 1, comprising the following steps:

introducing medicinal product portions into bubbles of a macro blister pack packaging, sealing said bubbles with a film.

20. Method for producing a macro blister pack according to claim 1, comprising the following steps:

introducing medicinal product portions into bubbles of a blister web, sealing said bubbles with a film, separating off the macro blister pack from the blister web.

21. Method for providing medicinal product portions for one or more patients, comprising the following steps (A) producing a macro blister pack according to claim 1, (B) storing the macro blister pack, (C) dividing the macro blister pack into a number N of ready-for-use blister packs, where N is an integer greater than 8, (D) introducing a number n of ready-for-use blister packs from step (C) into a secondary packaging, where n is an integer greater than or equal to 1.

22. Method according to claim 21, wherein, after step (B) and before step (D), country- and/or customer-specific information is applied to the macro blister pack and/or the ready-for-use blister packs.

23. Method according to claim 21, wherein each ready-for-use blister pack contains a number of medicinal product portions corresponding precisely to a dosage.

24. Method according to claim 21, wherein N=T.

25. Method according to claim 21, wherein a stack of n=2 to 64 ready-for-use blister packs is introduced into the secondary packaging.

26. Stack comprising at least two ready-for-use blister packs, each containing an individual medicinal product portion, the ready-for-use blister packs having been produced by dividing a macro blister pack according to claim 1 and having no sharp corners and edges.

27. Stack according to claim 26, wherein the ready-for-use blister packs have a flat side and a belly side and carry a machine-readable optical code on the belly side.

28. Secondary packaging containing a stack according to claim 26.

29. Secondary packaging according to claim 28, having a lower region with an opening through which an individual ready-for-use blister pack can be removed from the secondary packaging, the ready-for-use blister pack arranged above being moved down as a result of the force of gravity, following the removal of a ready-for-use blister pack.

30. System for producing packaged medicinal product portions intended to be passed on to patients, comprising (A) an apparatus for producing a macro blister pack according to claim 1 containing the medicinal product portions, (B) a store for storing the macro blister pack, (C) an apparatus for dividing the macro blister pack into a number N of ready-for-use blister packs, where N is an integer greater than 8, (D) an apparatus for introducing a number n of ready-for-use blister packs into a secondary packaging, where n is an integer greater than or equal to 1.

31. System according to claim 30, the apparatus for producing the macro blister pack and the apparatus for dividing the macro blister pack being provided at different locations.

32. System according to claim 30, further comprising an apparatus for applying information to a macro blister pack and/or to a ready-for-use blister pack.

33. System according to claim 32, the apparatus for producing the macro blister pack and the apparatus for applying information to the macro blister pack and/or to a ready-for-use blister pack being provided at different locations.

* * * * *